US009263815B2

(12) United States Patent
Yu et al.

(10) Patent No.: US 9,263,815 B2
(45) Date of Patent: Feb. 16, 2016

(54) RECHARGEABLE BATTERY SOCKET AND MANUFACTURING METHOD THEREOF

(75) Inventors: Wang-I Yu, Jhonghe (TW); Hung-Chi Tai, Jhonghe (TW); An-Yu Yu, Jhonghe (TW); Yung-Chih Hung, Jhonghe (TW); Jie-Jun Zeng, Taicang (CN); Kuo-Cheng Liu, Jhonghe (TW)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 533 days.

(21) Appl. No.: 13/595,463

(22) Filed: Aug. 27, 2012

(65) Prior Publication Data

US 2013/0344747 A1 Dec. 26, 2013

(30) Foreign Application Priority Data

Jun. 20, 2012 (CN) ..... 2012 1 0203880

(51) Int. Cl.

| | |
|---|---|
| ***H01R 13/11*** | (2006.01) |
| ***H01R 13/428*** | (2006.01) |
| ***H01R 13/422*** | (2006.01) |
| ***H01R 13/648*** | (2006.01) |
| *H01R 11/12* | (2006.01) |

(52) U.S. Cl.

CPC ..... *H01R 13/112* (2013.01); *H01R 13/422* (2013.01); *H01R 13/428* (2013.01); *H01R 13/648* (2013.01); *H01R 11/12* (2013.01); *Y10T 29/4922* (2015.01)

(58) Field of Classification Search

CPC .. H01R 13/428; H01R 13/112; H01R 13/115; H01R 13/422

USPC ..... 439/658, 682, 856, 271, 272

See application file for complete search history.

(56) References Cited

U.S. PATENT DOCUMENTS

| | | | | |
|---|---|---|---|---|
| 4,685,886 | A * | 8/1987 | Denlinger et al. | 439/55 |
| 5,951,331 | A * | 9/1999 | Li-Ming et al. | 439/682 |
| 6,666,714 | B1 * | 12/2003 | Li et al. | 439/521 |
| 6,705,902 | B1 * | 3/2004 | Yi et al. | 439/678 |
| 7,070,456 | B1 * | 7/2006 | Peng et al. | 439/682 |
| 7,402,064 | B2 * | 7/2008 | Daily et al. | 439/290 |
| 7,553,167 | B2 * | 6/2009 | Zhang et al. | 439/497 |
| 8,096,843 | B2 * | 1/2012 | Gong | 439/856 |

* cited by examiner

*Primary Examiner* — Felix O Figueroa

(74) *Attorney, Agent, or Firm* — Sughrue Mion, PLLC

(57) ABSTRACT

A rechargeable battery socket and the manufacturing method of making the same is disclosed. The rechargeable battery socket includes an insulating housing defining a number of terminal channels, a number of terminals received in the insulating housing, and a shell assembled to one side of the insulating housing. Each terminal includes a contacting portion received in corresponding terminal channel and a tail extending out of the insulating housing. Each terminal channel provides a pair of ribs on two opposite inside faces thereof. The contacting portion of the terminal cooperates with the rib to thereby secure the terminal in the insulating housing.

10 Claims, 13 Drawing Sheets

RECHARGEABLE BATTERY SOCKET AND MANUFACTURING METHOD THEREOF

BACKGROUND OF THE INVENTION

1. Field of the Invention

The present invention relates to electrical connectors, and more particularly, to a rechargeable battery socket and manufacturing method thereof.

2. Description of Related Art

Electric vehicles, such as electric car, electric bicycle, are popular used nowadays for their quiet running and pollution-free. Generally, the rechargeable battery is employed for providing energy to the electric vehicles. Many rechargeable batteries are separately assembled to the electric vehicles, which should be electrically connecting with the power supply system when electricity thereof is not enough to drive the vehicle. In most environments, a rechargeable battery socket is used as an intermediate device to connect the battery and the power supply system.

Hence, a rechargeable battery socket with high performances, such as dust-proof, water-proof, is therefore desired.

BRIEF SUMMARY OF THE INVENTION

The present invention provides a rechargeable battery socket and the manufacturing method of making the same. The rechargeable battery socket includes an insulating housing defining a plurality of terminal channels, a plurality of terminals received in the insulating housing, and a shell assembled to one side of the insulating housing. Each terminal includes a contacting portion received in corresponding terminal channel and a tail extending out of the insulating housing. Each terminal channel provides a pair of ribs on two opposite inside faces thereof. The contacting portion of the terminal cooperates with the rib to thereby secure the terminal in the insulating housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
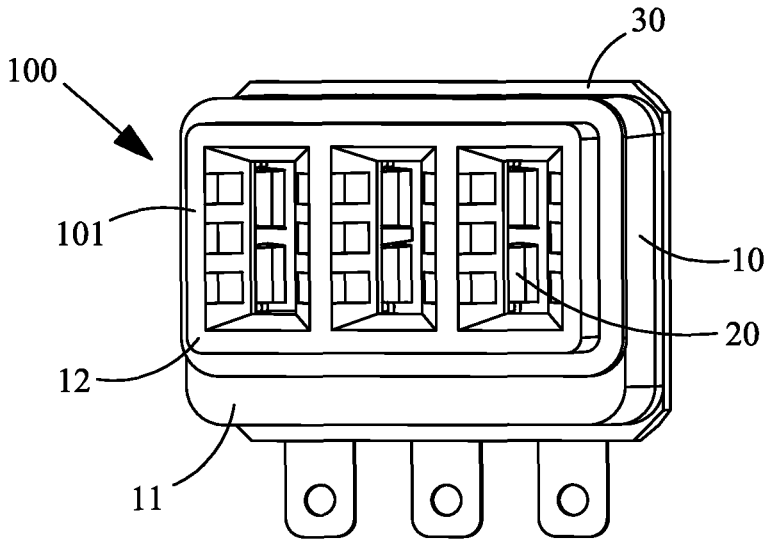
FIG. 1 is a perspective view of a rechargeable battery socket in accordance with a first embodiment of the present invention.

Reference will now be made to the drawing figures to describe the embodiments of the present invention in detail. In the following description, the same drawing reference numerals are used for the same elements in different drawings.

Figure 2:
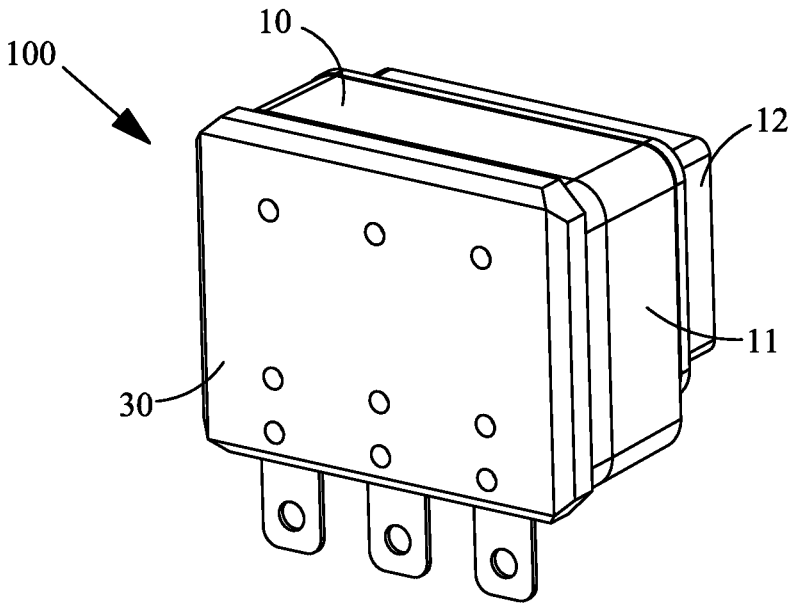
FIG. 2 is a view similar to FIG. 1 while taken from another aspect.

Referring to FIGS. 1 and 2, the present invention discloses a rechargeable battery socket 100 including an insulating housing 10, a plurality of terminals 20 received in the insulating housing 10, a shell 30 attached to one side of the insulating housing 10, and a washer 40 assembled to the insulating housing 10.

Referring to FIG. 1, in the first preferred embodiment, the insulating housing 10 has a main section 11 and a mating section 12 extending forwardly from the main section 11. Both the main section 11 and the mating section 12 have a substantial rectangular shaped cross section. The area of the cross section of the mating section 12 is larger than that of the main section 11. The insulating housing 10 has a front face 101 and a rear face 102 opposite to the front face 101. A plurality of terminal channels 13 are defined in the insulating housing and extend from the front face 101 to the rear face 102. That is, the terminal channel 13 extends through the main section 11 and the mating section 12. The terminal channel 13 opens at both the front face 101 and rear face 102. A pair of ribs 131 are defined on opposite inside faces of each terminal channel 13. The rib 131 protrudes inwardly and extends along a front-to-back direction. A block 132 is formed in the front of the rib 131 and adjacent to the front face 101 of the insulating housing 10. The block 132 has a slanted guiding surface 1321 formed therealong and a plurality of recesses 1322 recessed from the slanted guiding surface 1321. The main section 11 of the insulating housing 10 defines a plurality of cutouts 111 surrounding the terminal channels 13. A plurality of protrusions 112 are defined between each two adjacent cutouts 111. Each terminal channel 13 has a pair of grooves 133 defined in the inside faces and located at a rear end thereof. The grooves 133 engage with the terminals 20 to thereby secure the terminals 20 on the insulating housing 10.

Figure 3:
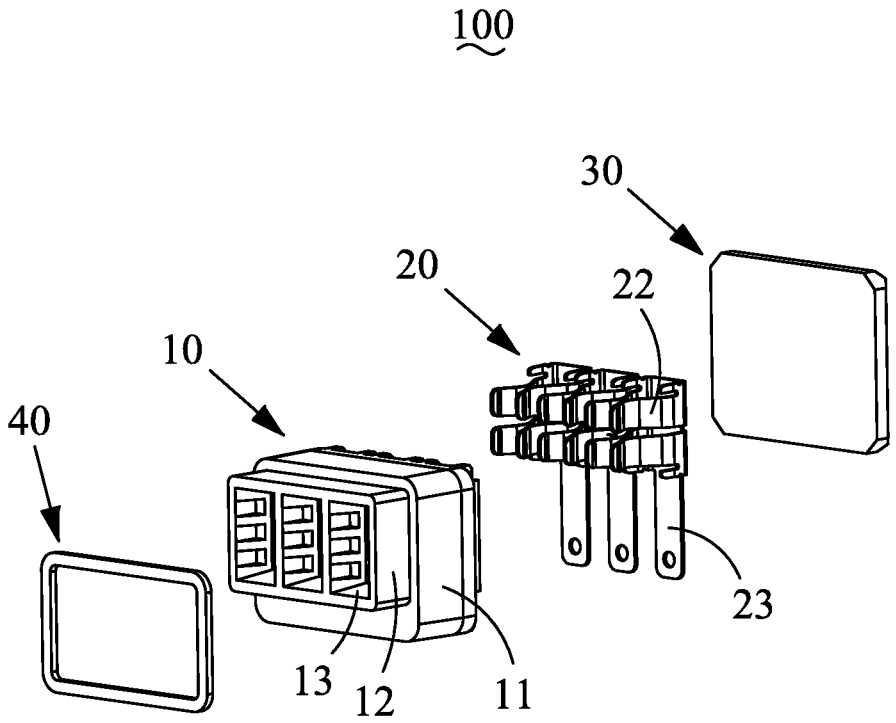
FIG. 3 is an exploded, perspective view of the rechargeable battery socket shown in FIG. 1.
Figure 4:
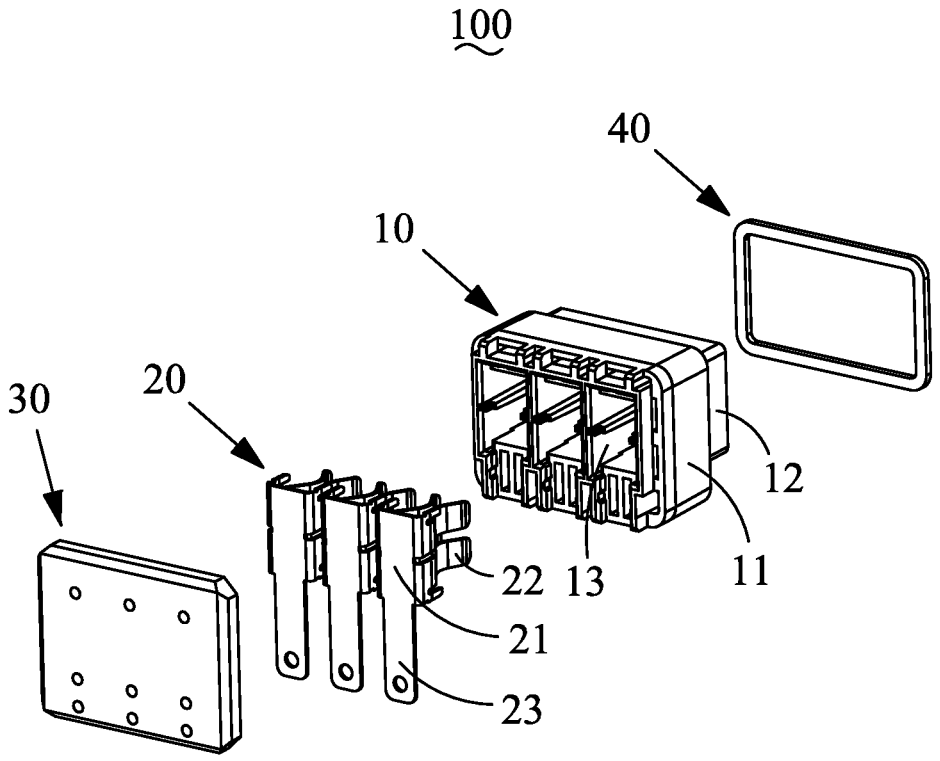
FIG. 4 is a view similar to FIG. 3 while taken from another aspect.
Figure 5:
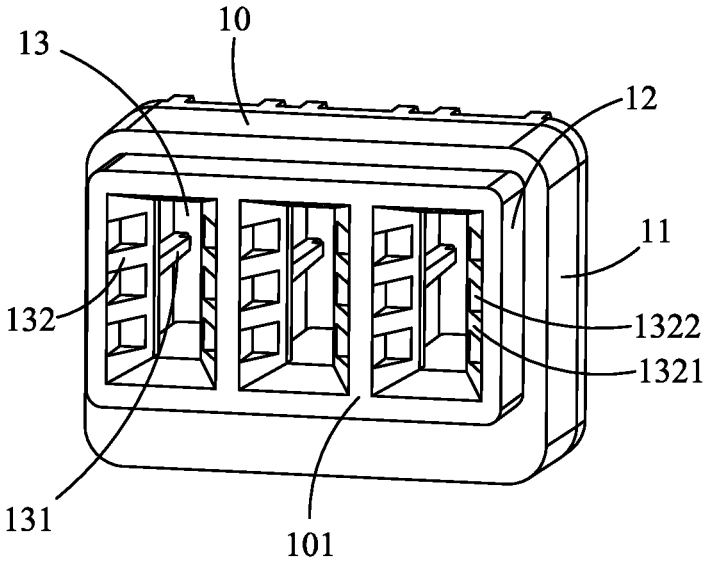
FIG. 5 is a perspective view of an insulating housing of the rechargeable battery socket shown in FIG. 1.
Figure 6:
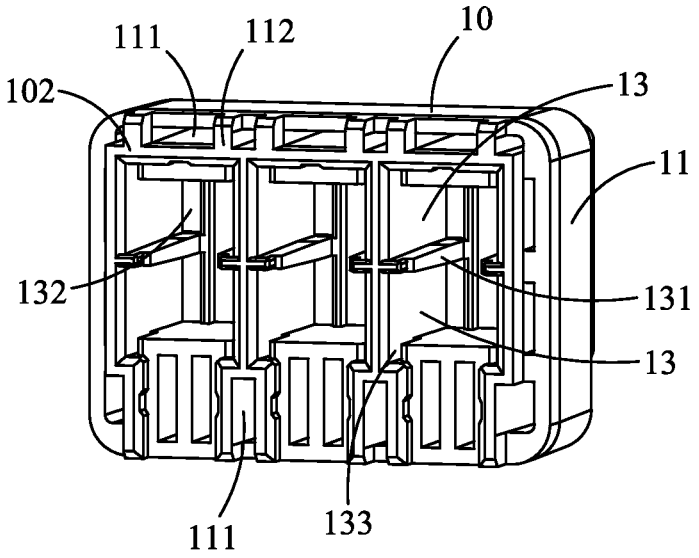
FIG. 6 is a view similar to FIG. 5 while taken from a different aspect.
Figure 7:
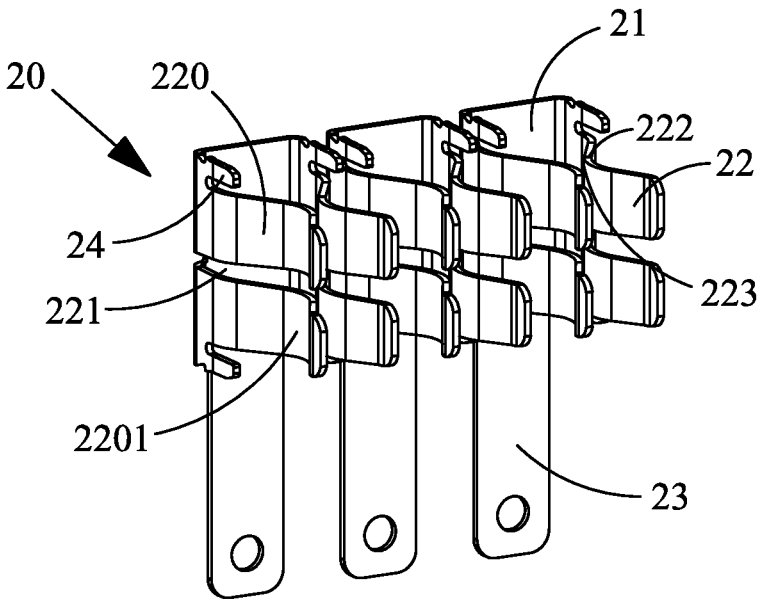
FIG. 7 is a perspective view of terminals of the rechargeable battery socket.
Figure 8:
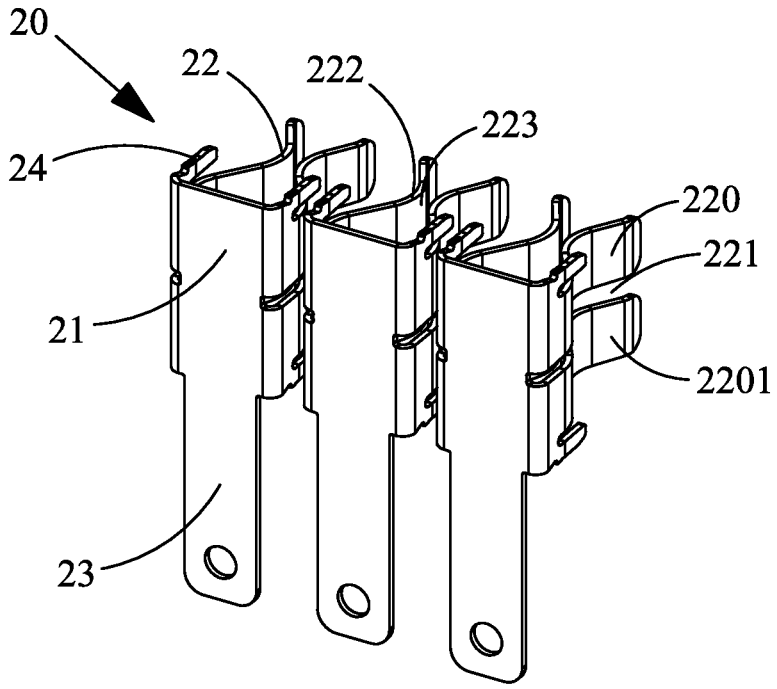
FIG. 8 is a view similar to FIG. 7 while taken from a different aspect.

Referring together to FIGS. 3 and 4, each terminal 20, which is formed for connecting with a wire (not shown), comprises a base portion 21, a contacting portion 22 interconnect to the base portion 21 and a tail 23 extending from a rear edge of the base portion 21. The base portion 21 has a substantial U-shaped cross section. In the first preferred embodiment, the contacting portion 22 comprises a pair of contacting pads 220, each of which defines a slot 221 thereal-long. The contacting pad 220 is divided by the slot 221 into two contacting fingers 2201. The slot 221 receives the rib 131 of the terminal channel 13 to thereby limit the terminal 20 in the terminal channel 13. The contacting pad 220 includes a bent portion 222. A guiding slot 223 is defined between the two bent portions 222 of the contacting portion 22 for a mating contact of a complementary connector (not shown) inserting therein. The terminal 20 has a retaining tail 24 retained in the groove 133 of the insulating housing 10 to thereby secure the terminal 20 in the corresponding terminal channel 13.

The shell 30 is inserted-molding on the insulating housing 10 from the rear face 102 thereof. The cutouts 111 and the protrusions 112 provide grasping force for securing the shell 30 to the insulating housing 10.

In assembly, the terminals 20 are inserted into the terminal channels 13 of the insulating housing 10 from the rear face 102 thereof. The slot 221 of the terminal 20 receives the rib 131 of the insulating housing 10 and the retaining tail 24 is inserted within the groove 133. At the same time, the front end of the contacting portion 22 of the terminal 20 is stopped by the blocks 132 to thereby accurately locate the terminal 20.

Figure 9:
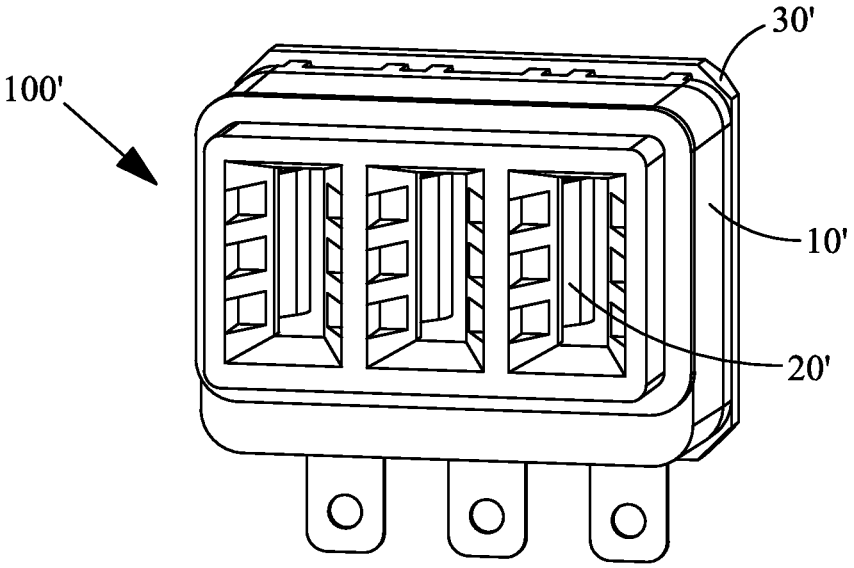
FIG. 9 is a perspective view of the rechargeable battery socket in accordance with a second embodiment of the present invention.
Figure 10:
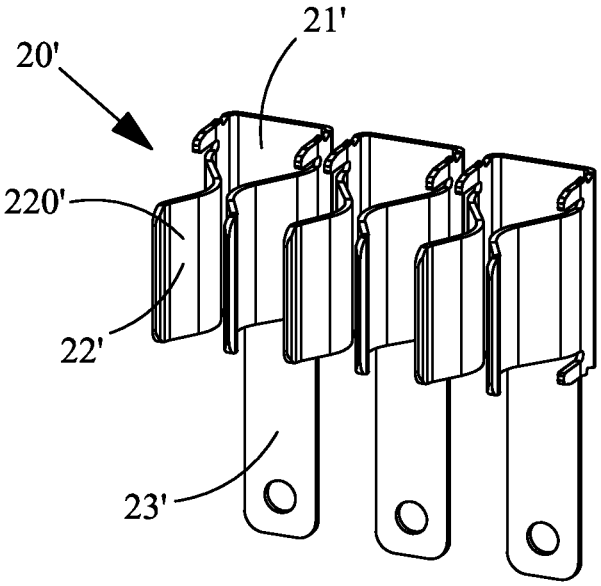
FIG. 10 is a perspective view of terminals of the rechargeable battery socket shown in FIG. 9.
Figure 11:
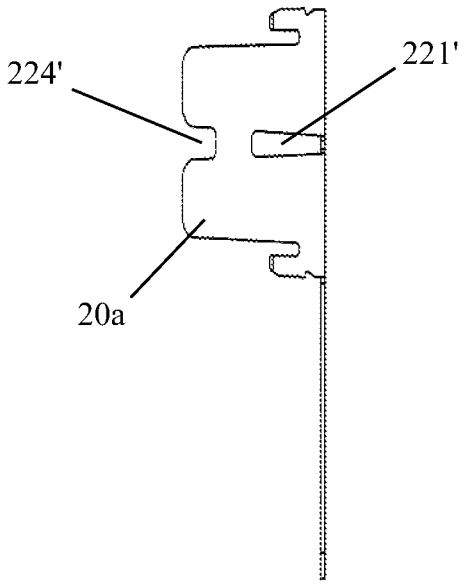
FIG. 11 is a side view of a terminal of the rechargeable battery socket.
Figure 12:
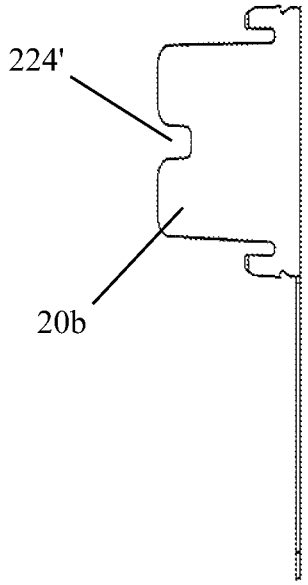
FIG. 12 is a side view of another terminal of the rechargeable battery socket.
Figure 13:
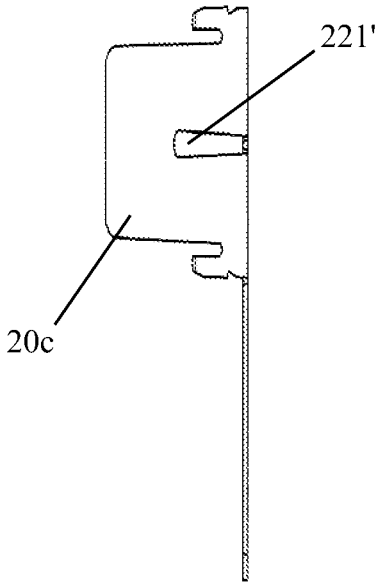
FIG. 13 is a side view of still another terminal of the rechargeable battery socket.

Referring to FIGS. 9 and 10, the second embodiment of the present invention is similar to the first embodiment. In the second embodiment, the rechargeable battery socket 100' includes an insulating housing 10', a plurality of terminals 20' received in the insulating housing 10', a shell 30' inserted-molding on the insulating housing 10' from a rear side, and a washer 40' attached to the front end of the insulating housing 10'. Similarly, each terminal 20' also comprises a U-shaped base portion 21', a contacting portion 22' connecting with the U-shaped base portion 21', and a tail 23'. The contacting portion 22' includes a pair of contacting pads 220'. While, in the second embodiment, each contacting pad 220' is formed without the slot 221 which is disclosed in the first embodiment. As can be understood, the contacting pad 220' can be any shape which is different from either the first embodiment or the second embodiment. Turn to FIGS. 11 to 13, the contacting pad 220' with different shapes or configurations are disclosed. In FIG. 11, the contacting portion (not labeled) of the terminal 20*a* is formed with a recess 224' recessed from an edge thereof. Simultaneously, a slot 221' is provided. In FIG. 12, the contacting portion of the terminal 20*b* is provided with the recess 224' while without the slot. In FIG. 13, the contacting portion of the terminal 20*c* is provided with only the slot 221' while without the recess 224'. In a whole, the recess 224' or the slot 221' can be selected to be formed in the terminal.

The manufacturing method of the present invention includes the following steps:

Step 1: providing a metal sheet and cutting the metal sheet to form a terminal carrier;

Step 2: electroplating the terminal carrier;

Step 3: cutting and bending the terminal carrier of the Step 2 to form terminals, each terminal 20 comprising a U-shaped base portion 21, a contacting portion 22 extending from the U-shaped base portion 21, and a tail 23 extending from a rear edge of the U-shaped base portion 21;

Step 4: providing an insulating housing 10 which defines a plurality of terminal channels 13 thereof;

Step 5: assembling the terminals of Step 3 into the terminal channels 13 of the insulating housing 10; and Step 6: inserted-molding a shell 30 on a subassembly which is composed by the terminals 20 and the insulating housing 10.

Step 7: providing a washer 40 assembled onto a mating section 12 of the insulating housing.

The insulating housing 10 formed by Step 4 includes a main section 11 and the mating section 12 extending from the main section 11. The U-shaped base portion 21 of the terminal 20 formed by Step 3 defines an angle at a bottom edge thereof. The angle is between 92 degrees to 100 degrees.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A rechargeable battery socket comprising:

an insulating housing defining a plurality of terminal channels;

a plurality of terminals received in the insulating housing, each terminal comprising a contacting portion received in corresponding terminal channel and a tail extending out of the insulating housing; and a shell assembled to one side of the insulating housing; wherein each terminal channel provides a pair of ribs on two opposite inside faces thereof; and wherein the contacting portion of the terminal cooperates with the rib to thereby secure the terminal in the insulating housing;

wherein the insulating housing comprises a main section and a mating section extending from the main section, and wherein the terminal channel is extending throughout the main section and the mating section.

2. The rechargeable battery socket as claimed in claim 1, wherein the contacting portion of the terminal defines a slot, and wherein the rib of the terminal channel is engaged in the slot.

3. The rechargeable battery socket as claimed in claim 2, wherein the contacting portion of the terminal has a pair of contacting pads, and wherein each of the pair of contacting pads is divided by the slot to form a pair of contacting fingers.

4. The rechargeable battery socket as claimed in claim 2, wherein the contacting portion of the terminal has a pair of contacting pads, and wherein each of the pair of contacting pads defines a recess at a front edge thereof.

5. The rechargeable battery socket as claimed in claim 2, wherein the terminal comprises a base portion with a U-shaped cross-section thereof, and wherein the contacting portion extends from opposite sides of the base portion.

6. The rechargeable battery socket as claimed in claim 5, wherein the terminal channel has a pair of grooves defined in the inside faces.

7. The rechargeable battery socket as claimed in claim 6, wherein the base portion of the terminal provides a retaining tail adjacent to the contacting portion, and wherein the retaining tail is secured within the groove to thereby firmly retain the terminal in the insulating housing.

8. The rechargeable battery socket as claimed in claim 1, wherein the main section of the insulating housing defines a plurality of cutouts surrounding the terminal channels, and wherein a plurality of protrusions are defined between each two adjacent cutouts.

9. The rechargeable battery socket as claimed in claim 8, wherein the shell is inserted-molding on the insulating housing and firmly attached to the insulating housing by the plurality of protrusions.

10. The rechargeable battery socket as claimed in claim 1, further comprising a washer assembled on the mating section of the insulating housing.

* * * * *